US011684125B2

(12) United States Patent
Fumo

(10) Patent No.: US 11,684,125 B2
(45) Date of Patent: Jun. 27, 2023

(54) METHODS FOR ATTACHING A WEBBING OR A RIBBON TO A QUICK RELEASE BUCKLE AND A QUICK RELEASE BUCKLE

(71) Applicant: Nelson Fumo, Tyler, TX (US)

(72) Inventor: Nelson Fumo, Tyler, TX (US)

( * ) Notice: Subject to any disclaimer, the term of this patent is extended or adjusted under 35 U.S.C. 154(b) by 0 days.

(21) Appl. No.: 17/670,489

(22) Filed: Feb. 13, 2022

(65) Prior Publication Data

US 2022/0256978 A1 Aug. 18, 2022

Related U.S. Application Data

(60) Provisional application No. 63/150,879, filed on Feb. 18, 2021.

(51) Int. Cl.
*A44B 11/00* (2006.01)
*A44B 11/26* (2006.01)

(52) U.S. Cl.
CPC ..... *A44B 11/006* (2013.01); *A44B 11/266* (2013.01)

(58) Field of Classification Search
CPC ..... Y10T 24/2736; Y10T 24/4736
See application file for complete search history.

(56) References Cited

U.S. PATENT DOCUMENTS 1,284,972 A * 11/1918 Anthony ..... G09F 3/14 40/665
1,982,438 A * 11/1934 Keidel ..... G09F 3/0305 292/325
5,379,496 A * 1/1995 Krauss ..... F16G 11/10 24/615
7,082,652 B2 * 8/2006 St-Louis ..... A43C 7/00 24/715.4
2019/0107174 A1 * 4/2019 Sullivan ..... A44B 11/2546

* cited by examiner

*Primary Examiner* — Robert Sandy

(57) ABSTRACT

Two methods to attach a webbing or ribbon to a quick release buckle, and a quick release buckle for the use of the two methods are disclosed. Quick release buckles are designed to be used with webbing that is sewn to be attached to the quick release buckle, but for this invention two methods that do not require a sewing process are disclosed. One method uses a knot, and the other method uses a melted-solidified-end made on the webbing or ribbon using a melting method such as a flame or a hot iron or an ultrasonic welder.

1 Claim, 3 Drawing Sheets

METHODS FOR ATTACHING A WEBBING OR A RIBBON TO A QUICK RELEASE BUCKLE AND A QUICK RELEASE BUCKLE

FIELD OF THE INVENTION

The present invention pertains to devices used for quick connection-disconnection in applications such as safety belts, body harnesses, and safety car seats.

BACKGROUND

Quick release buckles are very widely used in many applications requiring a quick connection-disconnection. Quick release buckles are the preferred mean used in backpacks, safety harnesses, safety car seats for children, etc. to fastener the device for the intended use. For all the previous art, the quick release buckles are designed in many shapes and different lock mechanism but all of them are designed to be attached to the device by sewing a webbing (strap or strip) to the quick release buckle. For small quick releases, such as a mini quick release, a ribbon may be needed, and it is too difficult to sew the ribbon to be attached to the quick release buckle. The present invention substitutes the sewing process by using a knot or melted-solidified-end at the end of the webbing or ribbon.

SUMMARY

The two methods of the present invention overcome shortcomings related to sewing a webbing to a quick release buckle and particularly for strips such as a thin and narrow ribbon by using a knot or a melted-solidified-end instead of a sewing process. For the knot, the method uses a double-diameter point of connection in which the small diameter is for passing the ribbon and the larger diameter is to hold the knot. This method offers a greater strength than the sewing process because any force is applied directly to the material of the webbing/ribbon and not to the thread used in the sewing process. For the melted-solidified-end, the method uses a double-dimension point of connection. For spheric shape melted-solidified-end, the double diameter as the one for the knot method is used. However, for a linear shape melted-solidified-end, a channel is used to guide the webbing or ribbon to the linear double-dimension point of connection.

The quick release buckle disclosed as part of this invention has been invented using the disclosed methods and it can be made of any size taking into consideration the width and thickness of the webbing or ribbon.

An advantage of the disclosed methods when compared to the standard sewing process, is that the method does not need a sewing machine. This is very convenient especially in remote areas or in an emergency when a sewing machine will not be available.

DETAILED DESCRIPTION

The quick release buckle, as the preferred embodiment for this invention, has been invented to be used with two methods for attaching a webbing or ribbon to the quick release buckle without the need of sewing the webbing or ribbon.

Figure 1:
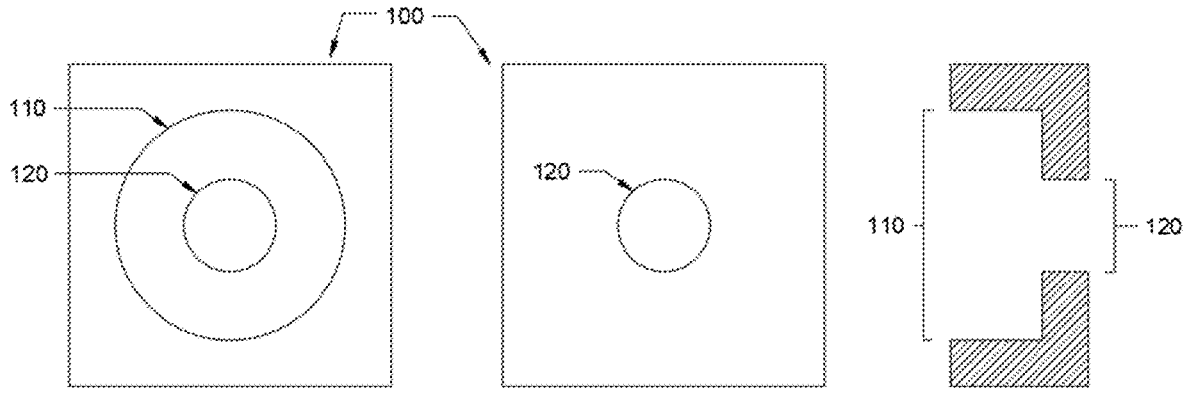
FIG. 1 shows the front view (on the left), the back view (at the center), and the cross section (on the right) of the double-diameter point of connection (100), identifying the large diameter (110) and the small diameter (120).
Figure 2:
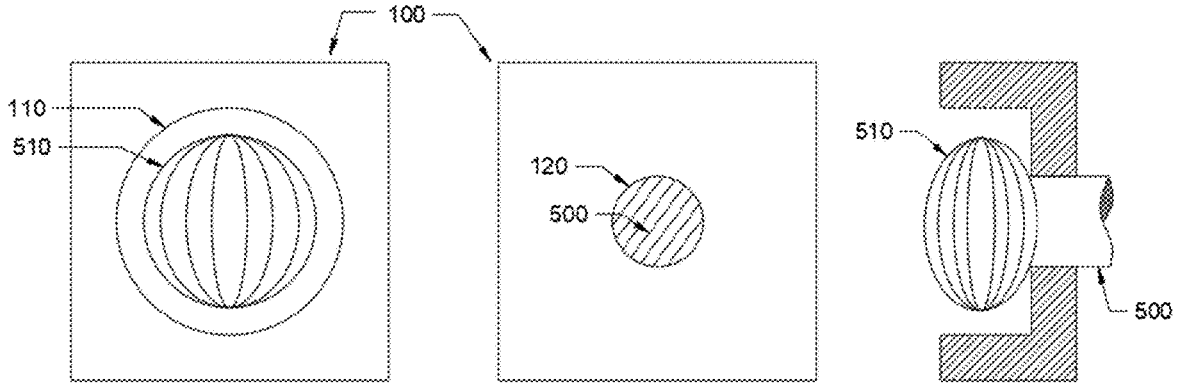
FIG. 2 shows the front view (on the left), the back view (at the center), and the cross section (on the right) of the double-diameter point of connection (100) with the melted-solidified-end (510) of the webbing or ribbon (500).
Figure 5:
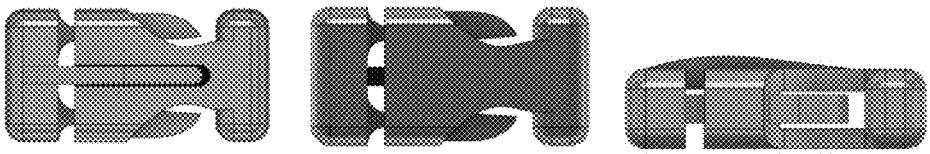
FIG. 5 shows the top, bottom, and lateral views of the assembled quick release buckle as the preferred embodiment.
Figure 6:
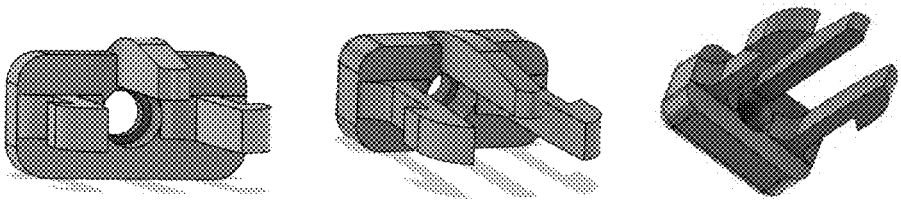
FIG. 6 shows isometric views of the front of the male of the quick release buckle with a double-diameter point of connection.
Figure 7:
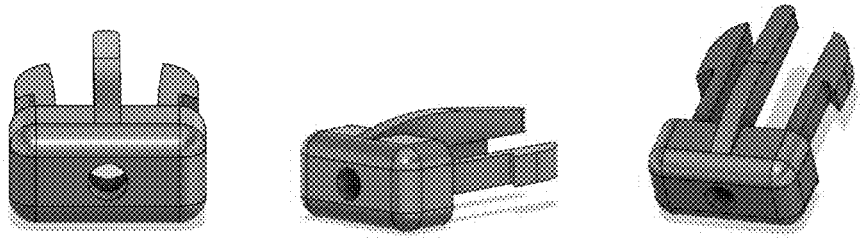
FIG. 7 shows isometric views of the back of the male of the quick release buckle with a double-diameter point of connection.
Figure 8:
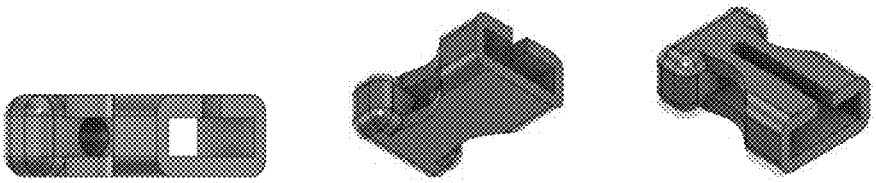
FIG. 8 shows isometric views of the front of the female of the quick release buckle with a double-diameter point of connection.
Figure 9:
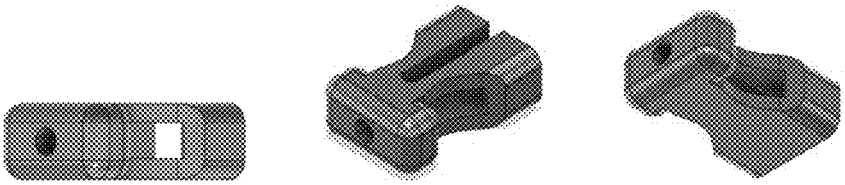
FIG. 9 shows isometric views of the back of the female of the quick release buckle with a double-diameter point of connection.
Figure 10:
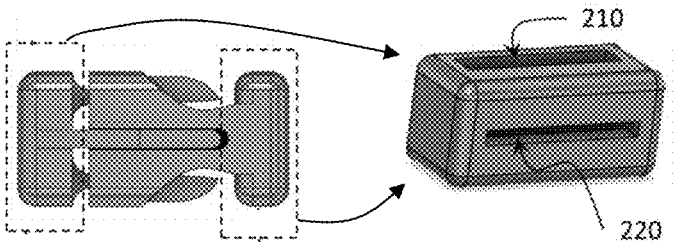
FIG. 10 shows an isometric view (on the right) of the double-dimension point of connection of the two ends of the quick release (on the left) for the use of a linear melted-solidified-end, identifying the large dimension (210) and the small dimension (220).

As in any quick release buckle, the quick release buckle of the present invention has two connecting ends where the webbing or ribbon can be attached to the quick release buckle. For the quick release buckle as the preferred embodiment of this invention, the two connecting ends can accommodate the two attaching methods disclosed. The first method uses a knot which is hold by the double-diameter point of connection (100) as shown in FIG. 1. The small diameter (120) is of such size that allows the webbing or ribbon (500) to pass through it but not the knot (510), while the larger diameter (110) is of such size that allows to hold the knot (510) as shown in FIG. 2. The second method takes advantage that generally webbings and ribbons are made of materials that can be melted, such as nylon, polypropylene, or polyester. Using a flame or a hot iron or ultrasonic welder the end of a webbing or ribbon (500) can be melted to create a linear melted-solidified-end (520) that is thick enough to pass the larger dimension (210) of the double-dimension point of connection (200) but not the small dimension (220). The double-diameter point of connection (100) can also be used with a melted-solidified-end that instead of being linear it is round like a knot. FIGS. 5 through 9 shows the quick release of the present invention with a double-diameter point of connection (100). FIG. 5 shows the top, bottom, and lateral views of the assembled quick release buckle. FIG. 6 shows three different isometric views of the front of the male of the quick release buckle. FIG. 7 shows three different isometric views of the back of the male of the quick release buckle. FIG. 8 shows three different isometric views of the front of the female of the quick release buckle. FIG. 7 shows three different isometric views of the back of the female of the quick release buckle. FIG. 10 shows the same quick release illustrating, within the dash lines, the ends of the male and female that can be substituted by a double-dimension point of connection (200). On the isometric view (on the right) of the double-dimension point of connection (200), the large dimension (210) and the small dimension (220) are identified.

Operation of the Presently Preferred Embodiment

For the first attaching method, the double-diameter point of connection (100) (see FIG. 1) using a knot (510) as shown in FIG. 2, an end of the webbing or ribbon (500) is folded or rolled so that the webbing or ribbon (500) can pass through the small diameter. Once the webbing or ribbon (500) has passed, a knot (510) is made, and the webbing or ribbon (500) is pulled to fit the knot (510) into the large diameter (110) as shown in FIG. 2. When the webbing or ribbon is pulled, the knot (510) cannot pass through the small diameter (120) and the webbing or ribbon (500) is secured to the quick release buckle.

Figure 3:
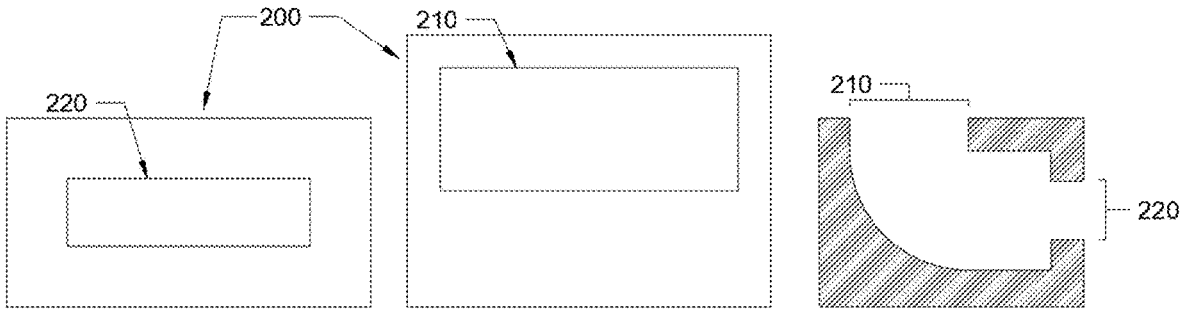
FIG. 3 shows the front view (on the left), the back view (at the center), and the cross section (on the right) of the double-dimension point of connection (200), identifying the large dimension (210) and the small dimension (220).
Figure 4:
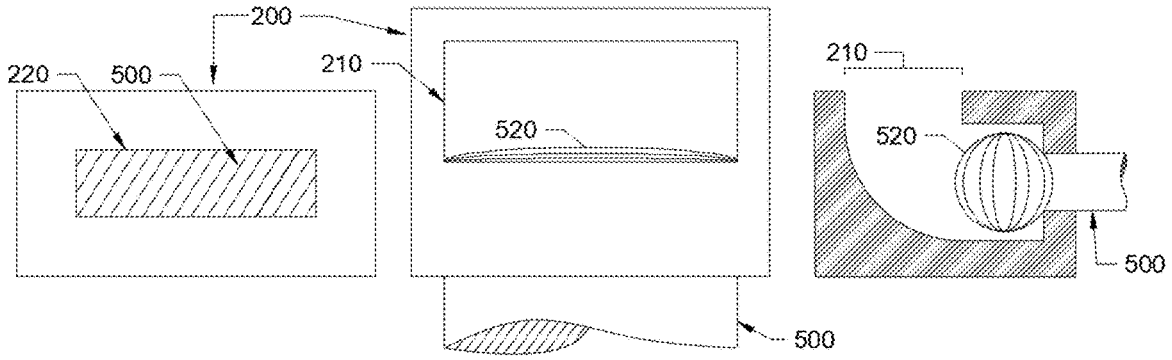
FIG. 4 shows the front view (on the left), the back view (at the center), and the cross section (on the right) of the double dimension-point of connection (200) with the melted-solidified-end (520) of the webbing or ribbon (500).

For the second attaching method, the double-dimension point of connection (200) (see FIG. 3) using a thick linear melted-solidified-end (520) as shown in FIG. 4, an end of the webbing or ribbon (500) is passed through the channel made between the large dimension (210) and the small dimension (220). The end of the webbing or ribbon (500) enters the groove of the small dimension (220) and leaves through the groove of the large dimension (210). Once the webbing or ribbon (500) has passed the channel, a thick linear melted-solidified-end is made by melting the material with a flame or a hot iron or ultrasonic welder. Then, the webbing or ribbon (500) is pulled to fit the thick end in the cavity of the channel. When the webbing or ribbon is pulled, the thick melted-solidified-end cannot pass through the small dimension (220) groove and the webbing or ribbon (500) is secured to the quick release buckle.

What is claimed is:

1. A method of attaching and securing a webbing or ribbon to a quick release buckle; comprising the steps of:

providing a quick release buckle having a double-dimension point of connection at connecting ends of the quick release buckle, each double-dimension point of connection having a small dimension portion (220) and a large dimension portion (210);

passing and end of a webbing or ribbon in a first direction through each of the small dimension portion and the large dimension portion of each double-dimension point of connection;

melting the end of the webbing or ribbon to form a melted-solidified-end; and pulling the webbing or ribbon in a second direction opposite to the first direction to fit the melted-solidified-end into the large dimension portion, where the melted-solidified-end cannot pass through the small dimension portion;

wherein the melted-solidified-end is made by a source of heat provided by flame, hot iron, or ultrasonic welder; and wherein the melted-solidified-end is formed in a shape to match a width of the webbing or ribbon.

* * * * *